US005523832A

United States Patent [19]

Hamamichi et al.

[11] Patent Number: 5,523,832

[45] Date of Patent: Jun. 4, 1996

[54] ELECTROPHOTOGRAPHIC IMAGE FORMING APPARATUS WITH CONTROLLED MIXING OF DEVELOPER

[75] Inventors: Suguru Hamamichi, Toyokawa; Naoyoshi Kinoshita; Naotoshi Kawai, both of Aichi-ken; Yoshihito Aoki, Chita, all of Japan

[73] Assignee: Minolta Camera Kabushiki Kaisha, Osaka, Japan

[21] Appl. No.: 67,009

[22] Filed: May 26, 1993

[30] Foreign Application Priority Data

May 29, 1992 [JP] Japan ..... 4-138677

[51] Int. Cl.[6] ..... G03G 21/00

[52] U.S. Cl. ..... 355/246; 355/208

[58] Field of Search ..... 355/208, 246, 355/204, 245; 118/657, 654, 658, 653, 668–692; 430/120

[56] References Cited

U.S. PATENT DOCUMENTS

| | | | |
|---|---|---|---|
| 4,338,019 | 7/1982 | Terashima et al. | 355/246 |
| 4,647,185 | 3/1987 | Takeda et al. | 118/689 X |
| 4,708,458 | 11/1987 | Ueda et al. | 355/246 X |
| 4,734,737 | 3/1988 | Koichi | 118/689 X |
| 4,860,063 | 8/1989 | Okamoto | 355/208 |
| 4,963,927 | 10/1990 | Ishihara | 355/208 X |
| 4,969,011 | 11/1990 | Faull et al. | 355/246 X |
| 5,182,600 | 1/1993 | Hasegawa et al. | 355/246 |
| 5,227,847 | 7/1993 | Motohashi et al. | 355/246 X |
| 5,285,242 | 2/1994 | Kotani | 355/208 |

FOREIGN PATENT DOCUMENTS

| | | | |
|---|---|---|---|
| 57-190973 | 11/1982 | Japan | 355/208 |
| 58-72967 | 5/1983 | Japan . | |
| 58-105263 | 6/1983 | Japan | 355/208 |
| 58-221868 | 12/1983 | Japan | 355/208 |
| 58-214174 | 12/1983 | Japan | 355/208 |
| 59-24867 | 2/1984 | Japan | 355/246 |
| 61-100768 | 5/1986 | Japan | 355/208 |
| 61-158354 | 7/1986 | Japan | 355/208 |
| 61-158355 | 7/1986 | Japan | 355/208 |
| 62-00979 | 1/1987 | Japan | 355/208 |

*Primary Examiner*—Arthur T. Grimley
*Assistant Examiner*—Shuk Y. Lee
*Attorney, Agent, or Firm*—Burns, Doane, Swecker & Mathis

[57] ABSTRACT

An image forming apparatus having a developing device which accommodates a developer for developing an electrostatic latent image formed on the surface of a latent image carrier, a developing member provided in said developing device for supplying the developer to the electrostatic latent image formed on the surface of the latent image carrier and a mixing member provided in the developing device for mixing the developer accommodated within the developing device. In the above image forming apparatus, the operating time of the mixing member is determined prior to the start of operation of the developing member based on at least one value of a toner density at the end of developing, the developer standing idle time, and the total number of developing cycles with the same developer.

14 Claims, 11 Drawing Sheets left time (T) (hour)
(1) : $T < 1$
(2) : $1 \leqq T \leqq 50$
(3) : $50 < T$ the number (S) of copy sheets
(1) : S < 5000
(2) : 5000 ≦ S ≦ 10000
(3) : 10000 < S developer mixing operation density Tc read
S60
Tc<6?
S61
Y
N
10<Tc?
S65
Y
N
time T, the number S read
S62
mixing time determined by table 1
S63
developer mixed
S64
return
time T, the number S read
S66
mixing time determined by table 2
S67
developer mixed
S68
return
time T, the number S read
S69
mixing time determined by table 3
S70
developer mixed
S71
return

ELECTROPHOTOGRAPHIC IMAGE FORMING APPARATUS WITH CONTROLLED MIXING OF DEVELOPER

BACKGROUND OF THE INVENTION

1. Field of the Invention

The present invention relates to an image forming apparatus of the electrophotographic type such as copying apparatus, printers and the like.

2. Description of the Related Art

Conventional image forming apparatus of the electrophotographic type typically use two-component developing devices which develop an electrostatic latent image formed on the surface of a latent image carrier by means of a two-component developer comprising a toner and a carrier. In this type of developing device, the toner and carrier must be mixed by means of a stirring member so as to electrically charge the toner. Accordingly, the two-component developer accommodated within a two-component developing device is generally mixed for a uniform time prior to the operation of the developing member so as to electrically charge the toner with a charge greater than a predetermined value. (This operation is referred to as "pre-development mixing" hereinafter.) When the operation of the developing member starts, The mixing member mixes the two-component developer within the developing device, or supplied developer to the developing member while mixing the two-component developer accommodated within the developing device and mixing the toner resupplied from the toner hopper into the developing device. The two-component developer supplied to the developing member is used to develop the electrostatic latent image formed on the surface of the latent image carrier.

The minimum time required for the aforesaid pre-development mixing (this time is referred to as "mixing time" hereinafter) varies depending on the condition of the aforesaid developer. The condition of the developer is determined by the toner density of the two-component developer accommodated in the developing device when mixing is started, the time during which the two-component developer has been left standing idle, frequency of use of the two-component developer and the like. The influence of the developer condition on the mixing time is shown in FIGS. 1–3. As is clearly shown in the aforesaid drawings, developer which has, for example a high toner density, stood idle over a long period, and deteriorated over long-term use requires a long mixing time to achieve a toner charge amount equal to or greater than a predetermined value $Q_1$. If the developing member is operated while the amount of charge is not $Q_1$ or greater, background fog and toner dispersion occur due to inadequate toner charging. Therefore, the mixing time is conventionally set at a uniform time so as to be of a length to allow sufficient charging of the toner even under the previously mentioned conditions of the developer.

In the previously described developing device, excessive mixing of the developer occurs when a long mixing time is not required, thereby accelerating the deterioration of the developer. Furthermore, the toner becomes excessively charged due to over mixing, such that the amount of toner adhering to the latent image carrier is reduced, thereby producing a decrease in image density.

U.S. Pat. No. 4,338,019 discloses a developing device for minimizing the mixing time to obtain a predetermined amount of toner charge, wherein the developer is mixed while the amount of toner charge is detected based on the output of a toner density sensor so as to operate the developing member when the toner charge reaches a predetermined level. However, in the case of this device, the amount of charge of the entire developer cannot be accurately detected because the amount of charge of the developer in the vicinity of the toner density detection area is unstable during the initial mixing period. Accordingly, mixing is stopped before the amount of charge of the entire developer is stabilized, resulting in mixing in excess of requirements.

SUMMARY OF THE INVENTION

A main object of the present invention is to provide an image forming apparatus wherein the developer does not deteriorate prematurely and the image density does not reduce.

A further object of the present invention is to provide an image forming apparatus wherein the toner is charged to a predetermined value in the minimum required time by accomplishing pre-development mixing in accordance with the condition of the developer.

These and other objects of the invention are accomplished by providing an image forming apparatus described below.

An image forming apparatus comprising:

a developing device accommodating a developer for developing an electrostatic latent image formed on the surface of a latent image carrier;

a developing member provided in said developing device for supplying the developer to the electrostatic latent image formed on the surface of the latent image carrier;

a mixing member provided in the developing device for mixing the developer accommodated within the developing device;

detecting means for detecting the condition of the developer, said detecting means including at least one of memory means for storing a toner density at the end of developing, clock means for clocking the developer standing idle time, and calculating means for calculating the total number of developing cycles with the same developer; and control means for controlling the operating time of the mixing member prior to the start of operation of the developing member based on the value obtained by said detecting means.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS (A) Developing device construction and operation FIG. 4 is a section view of a developing device within a developing unit (not illustrated) used in a full color copying apparatus of the electrophotographic type. The developing unit is provided with a plurality of developing devices which accommodate two-component developers which contain a carrier and toner of different colors, respectively, wherein a selected developing device is moved vertically to a position opposite a photosensitive member. This developing device 1 mainly comprises a developing section 10, developer mixing section 20 (hereinafter referred to as "mixing section"), and toner replenishing section 30.

Figure 1:
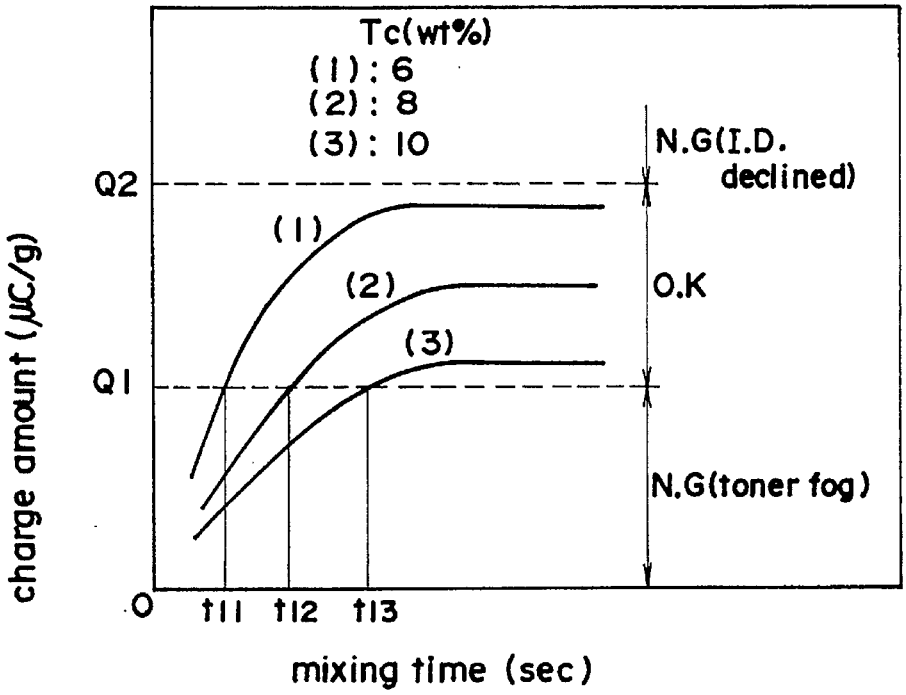
FIG. 1 is an illustration showing the differences in mixing time necessary to charge developers having different toner densities to a predetermined value or greater.
Figure 2:
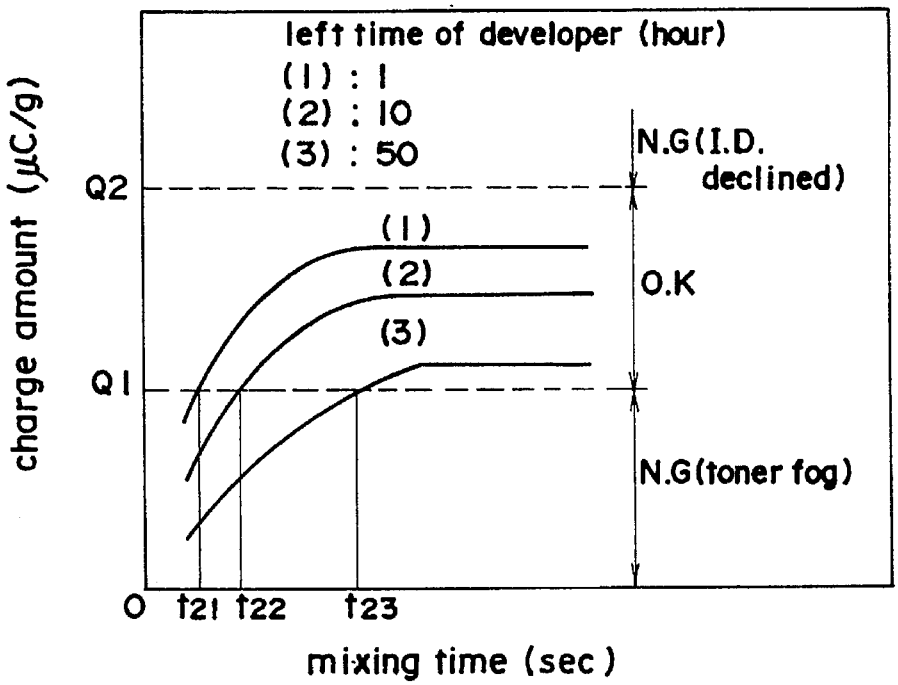
FIG. 2 is an illustration showing the differences in mixing time necessary to charge developers which have been allowed to stand idle for different lengths of time to a predetermined value or greater.
Figure 3:
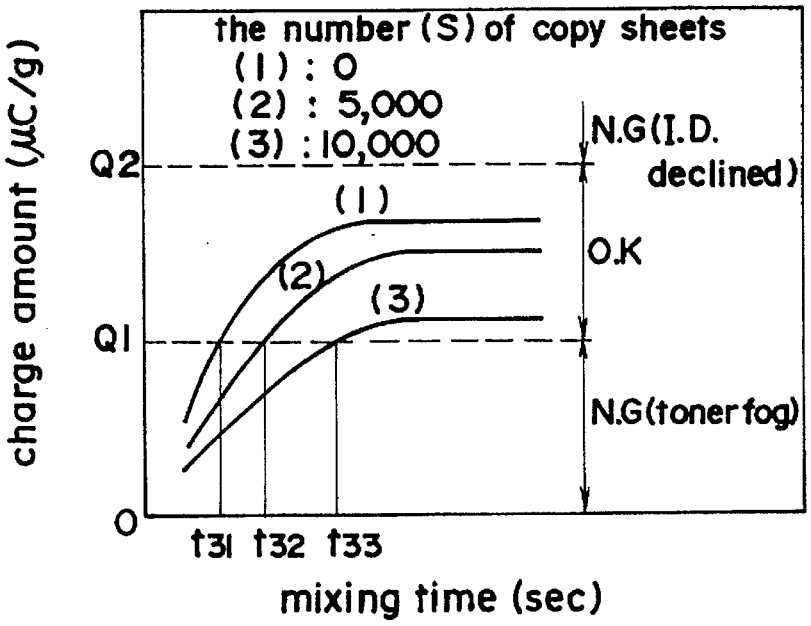
FIG. 3 is an illustration showing the differences in mixing time necessary to charge developers having different total number of developing cycles to a predetermined value or greater.
Figure 4:
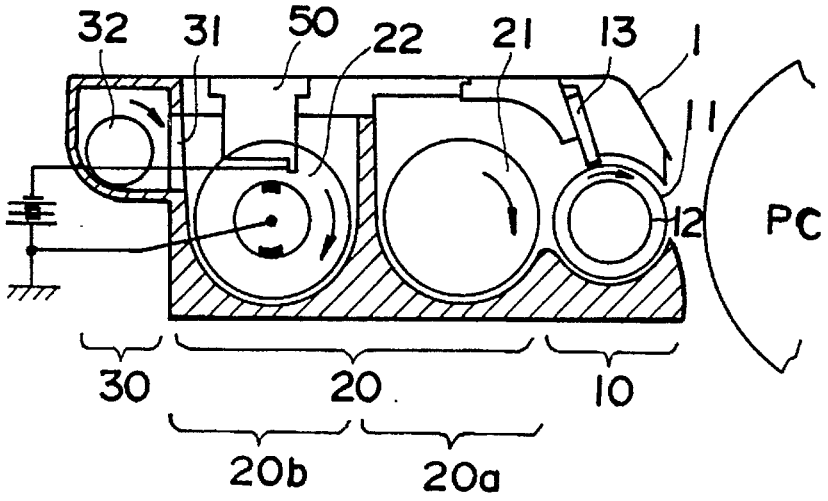
FIG. 4 shows a section view of the developing device of the present invention.

The developing sleeve 11 is provided in the developing section 10 so as to be adjacent to the photosensitive drum PC of the copying apparatus, and a fixed magnet 12 is provided within said developing sleeve 11. The developing sleeve 11 is rotatably driven in the arrow direction indicated in the drawing by means of a developing motor and developing clutch (not illustrated). The brush-height regulating member 13 is arranged at a position opposite the top exterior surface of the developing sleeve 11.

The first mixing roller 21 is provided in the first mixing section 20*a* of mixing section 20 so as to be adjacent to the developing sleeve 11, and a second mixing roller 22 is disposed posteriorly to said first mixing roller 21 in the second mixing section 20*b*. The ATDC sensor 50 for detecting toner density is disposed centrally above the aforesaid second mixing roller 22. The first mixing roller 21 and the second mixing roller 22 are both one or another rotatably drivel in the arrow direction indicated in the drawing by means of a mixing motor not shown in the illustration.

The toner replenishing section 30 is provided adjacent to the posterior side of the second mixing roller 22, and communicates with the mixing section 20 via the resupply aperture 31 provided on the interior side of the ATDC sensor 50, and further is connected to the toner hopper (not illustrated) so as to supply color toner from said toner hopper. The supply screw 32 is arranged within the replenishing section 30, and is rotatably driven in the arrow direction indicated in the drawing by means of the drive force of a toner replenishing motor not shown in the drawing.

During developing, the first mixing roller 21 and the second mixing roller 22 of the mixing section 20 mix the developer prior to the start of the operation of the developing section 20 by operating for a time period t in the manner previously described. When the developing section 20 commences operation, the developer is supplied to the developing sleeve 11 via the rotation of the first mixing roller 21, and said developer is maintained on the surface of the developing sleeve 11 by means of the magnetic force of the fixed magnet 12 provided within the developing sleeve 11, such that said developer is delivered to the developing region opposite the photosensitive drum PC. During the aforesaid developer transporting process, the amount of transported developer is regulated by the brush-height regulating member 13.

The developer delivered to the developing region develops the electrostatic latent image formed on the surface of the photosensitive drum PC so as to render said latent image visible, and the residual developer again travels toward the first mixing section 20*a* in accordance with the rotation of the developing sleeve 11. Furthermore, the developer prevented from being delivered to the developing region by the brush-height regulating member 13 is returned to the first mixing section 20*a*.

The first mixing roller 21 remixes the developer returned to the first mixing section 20*a* as described above. The second mixing roller 22 supplies the developer accommodated in the second mixing section 20*b* to the first mixing section 20*a*, and, when fresh toner is supplied to the second mixing section 20*b* via the rotation of the resupply screw 32 provided in the toner replenishing section 30, said second mixing roller 22 supplies developer to the first mixing section 20*a* after fresh toner has been mixed with the developer.

The resupply screw 32 is actuated during the period from the start of operation of the developing section 20 to the end of the developing operation so as to maintain a toner density within a constant range (6–10%) within the developing device 1 based on the output from the ATDC sensor 50. The specific detection method used to detect the toner density by the ATDC sensor 50 is a well known technology and is, therefore, omitted from the present discussion.

(B) Control of pre-development mixing time

The control of the mixing time based on the condition of the developer is described hereinafter. Although the controls described below are executed for each developing device of the developing unit, the following description pertains to the developing device 1 of the present embodiment. Specific operation of the developing device 1 has already been mentioned based on the flow charts of the reference drawings and is therefore omitted herefrom.

(B-1) Control-based on toner density

Figure 5:
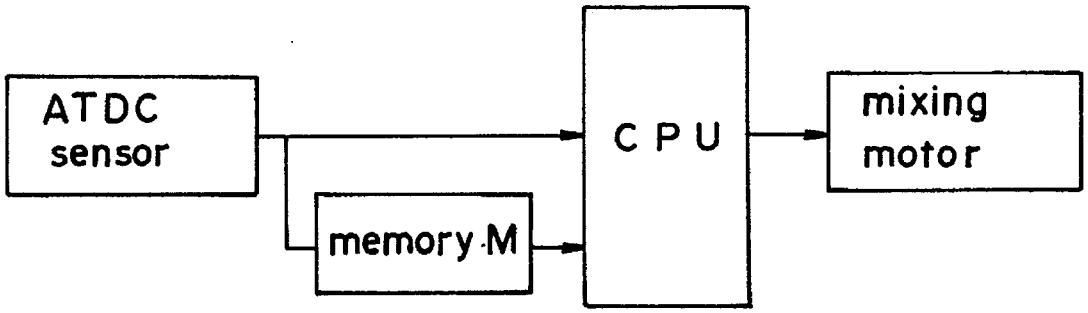
FIG. 5 is a block diagram showing the controls of the mixing time for developers having different toner densities.

The control of the mixing time based on toner density is described hereinafter with reference to FIGS. 5, 6 and 7. In this case, the output value of the ATDC sensor 50 at the end of the developing operation, i.e., the toner density Tc, is stored in memory M. (FIG. 5)

Figure 6A:
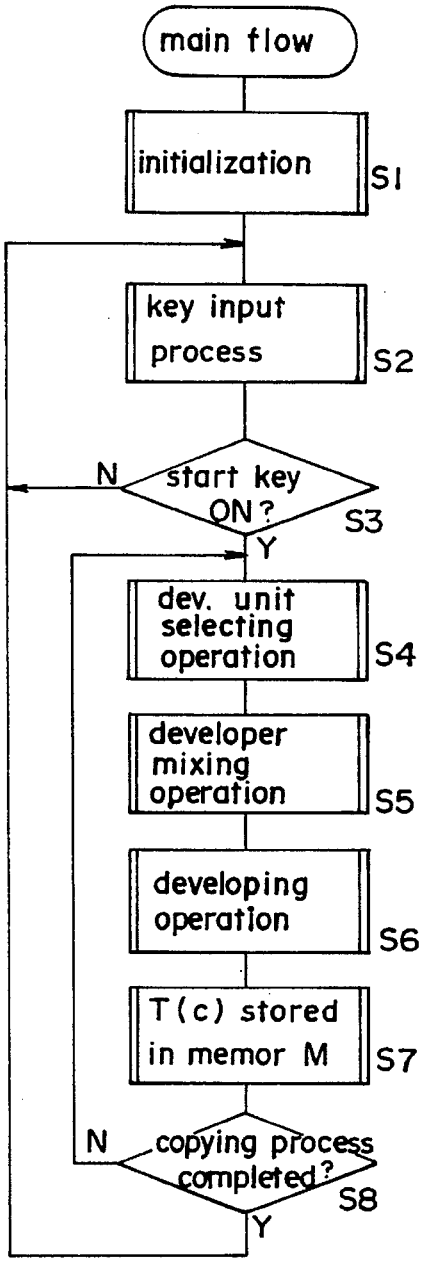
FIG. 6*a* is a flow chart showing the overall controls for the operation of the mixing section and developing section of the developing device.
Figure 6B:
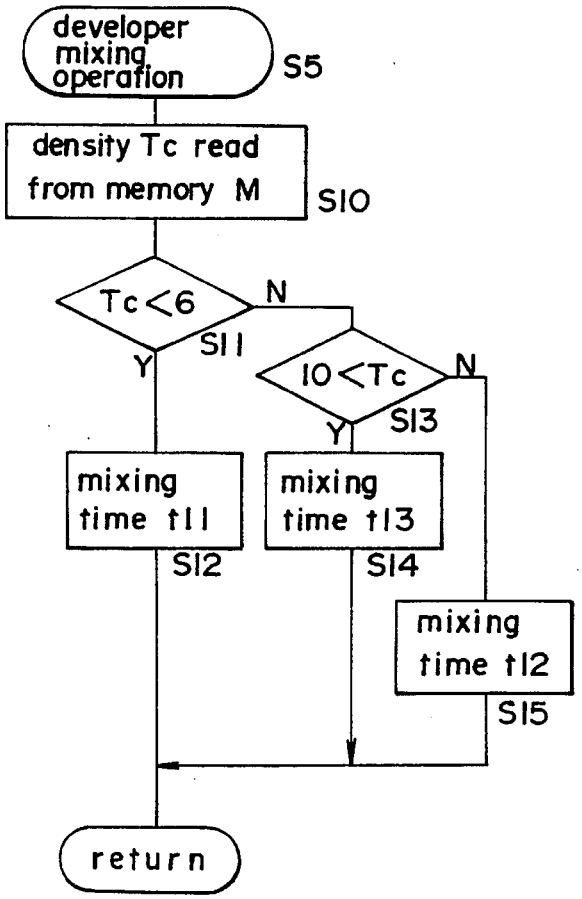
FIG. 6*b* is a flow chart showing the controls of the mixing time for developers having different toner densities.
Figure 7:
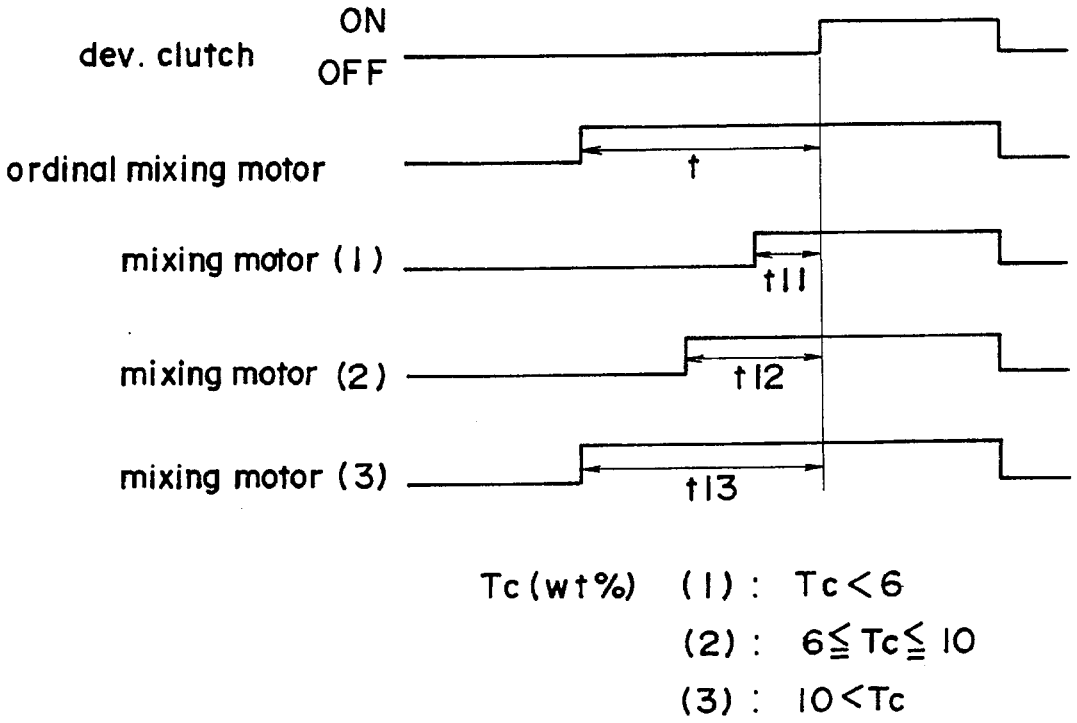
FIG. 7 is an operation timing chart for the mixing sections and developing sections of a conventional developing device and the developing device of the present invention.

In addition to the previously described operation, the toner density TC at the end of the developing operation is stored in memory M (step S7), as shown in FIG. 6*a*. The value stored in the memory M is read out when the developer is next mixed (step S10), as shown in FIG. 6*b*. Then, a check is made in the CPU to determine whether or not Tc<6 (step S11). If the reply to the query is YES, the mixing time is set at t11 (step S12). If the reply to the query is NO, a check is then made to determine whether or not 10<tc (step S13). If the reply to the query is YES, the mixing time is set at t13 (step S14). If the reply to the query is NO, the toner density is determined to be 6≦Tc≦10, and the mixing time is set at t12 (step S15). When the aforesaid mixing times are set, the mixing motor is operated for a period t11, t12 or t13 in accordance with the toner density, as shown in FIG. 7, and thereafter the developing clutch is turned ON to operate the developing section 10. When the entire developing operation ends, the output value of the ATDC sensor 50 is refreshed and stored in memory M.

(B-2) Control based on developer standing idle time

Figure 8:
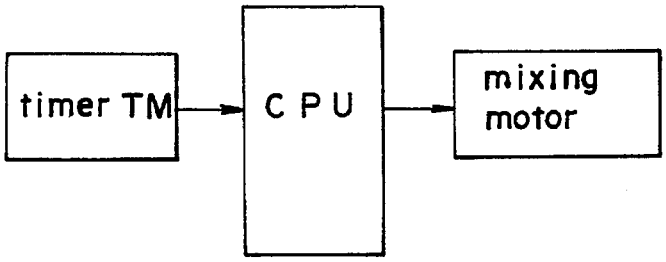
FIG. 8 is a block diagram describing the mixing time controls for developers which have been allowed to stand idle for different lengths of time.

The control of the mixing time based on the time the developer stands idle from the end of the previous developing operation is described hereinafter with reference to FIGS. 8, 9 and 10. In this case, the elapsed time from the end of the completed developing operation until the start of the subsequent developing operation is calculated by the timer TM. (FIG. 8)

Figure 9A:
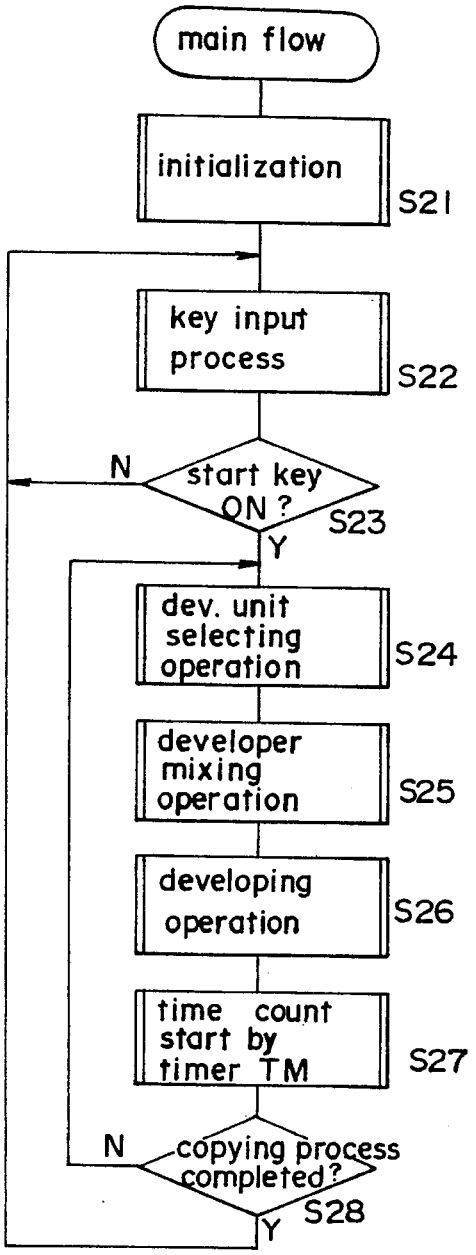
FIG. 9*a* is a flow chart showing the overall controls of the operation of the developing device.
Figure 9B:
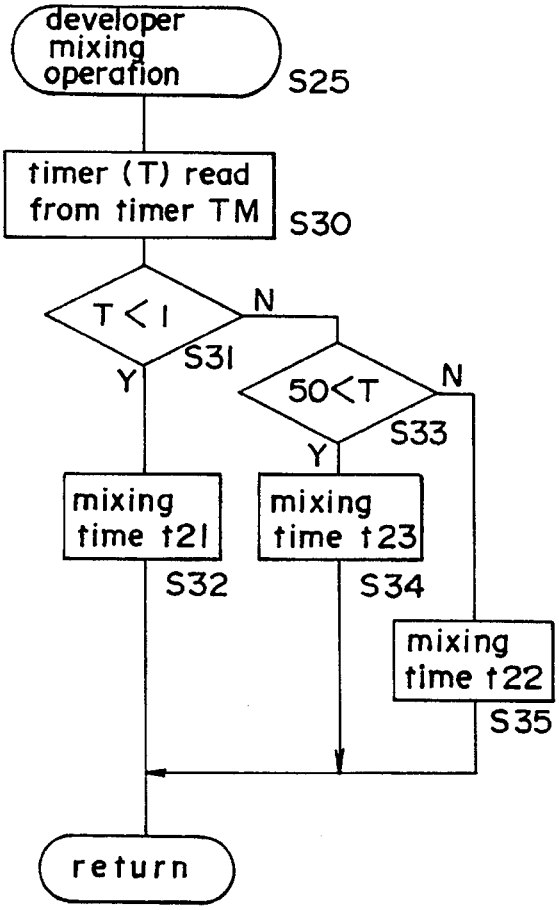
FIG. 9*b* is a flow chart showing the control of the mixing times for developers which have been allowed to stand idle for different lengths of time.
Figure 10:
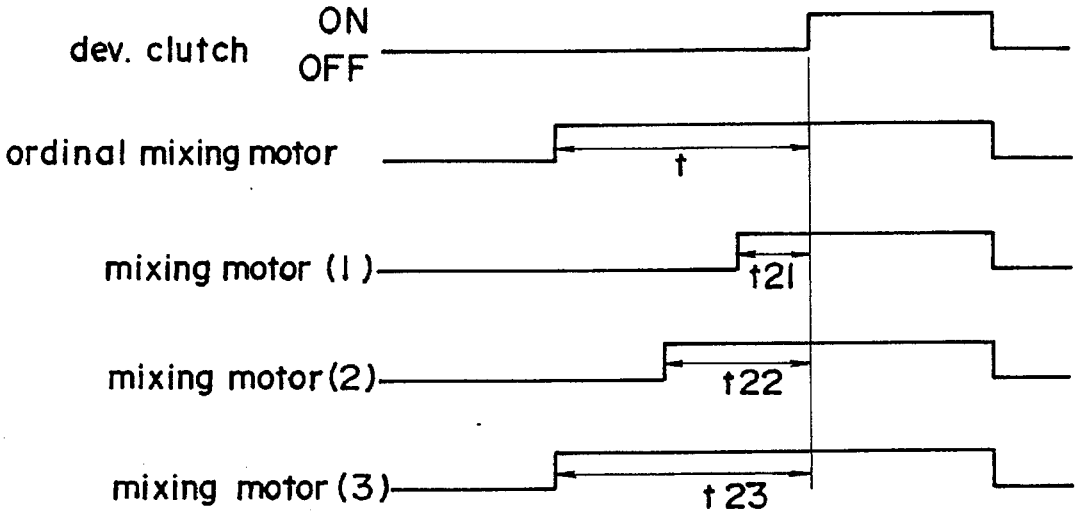
FIG. 10 is an operation timing chart for the mixing sections and developing sections of a conventional developing device and the developing device of the present invention.

The timer TM starts timing from the end of the completed developing operation in step S27 of FIG. 9*a*. Then, the elapsed time T until the mixing for the subsequent developing operation is output from the timer TM to the CPU (step S30), as shown in FIG. 9*b*. In the CPU, a check is made to determine whether or not T<1 (hour) (step S31). If the reply to the query is YES, the mixing time is set at t21 (step S32). If the reply to the query is NO, a check is made to determine whether or not 50<T (hour) (step S33). If the reply to the query is YES, the mixing time is set at t23 (step S34). If the reply to the query is NO, the elapsed time is determined to be 1≦T≦50 and the mixing time is set at t22 (step S35). After the mixing motor has been operated for the set time only, the developing clutch is turned ON to operate the developing section 10, as shown in FIG. 10. When the complete developing operation ends, the timer TM starts a new timing cycle.

(B-3) Control based on frequency of developer use

Figure 11:
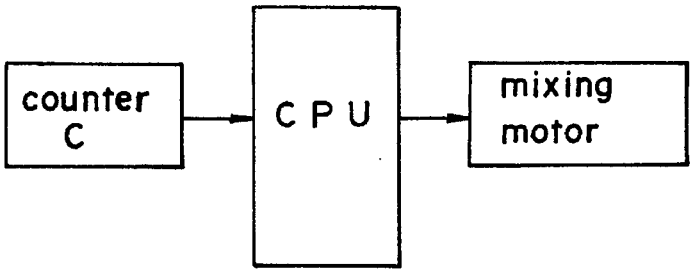
FIG. 11 is a block illustrating the control of the mixing times for the same developer in accordance with different total number of developing cycles.

The control of the mixing time based on the frequency of use of the developer, i.e., developer deterioration, is described hereinafter with reference to FIGS. 11, 12 and 13. In this case, the counter C counts the total number of developing cycles (number of copy sheets S) from the initial of use of the same developer. (FIG. 11)

Figure 12A:
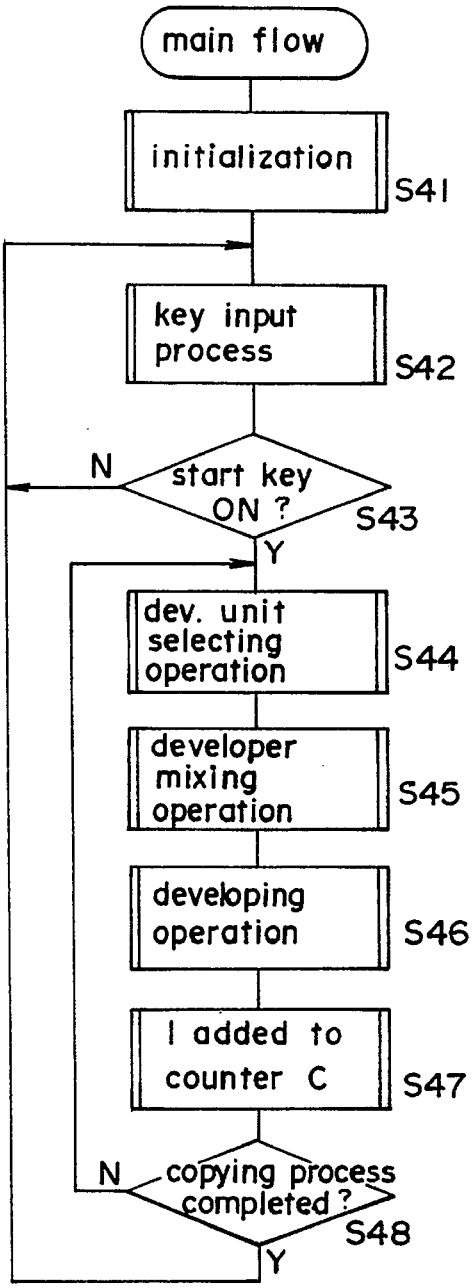
FIG. 12*a* is a flow chart showing the overall control for the operation of the developing device.
Figure 12B:
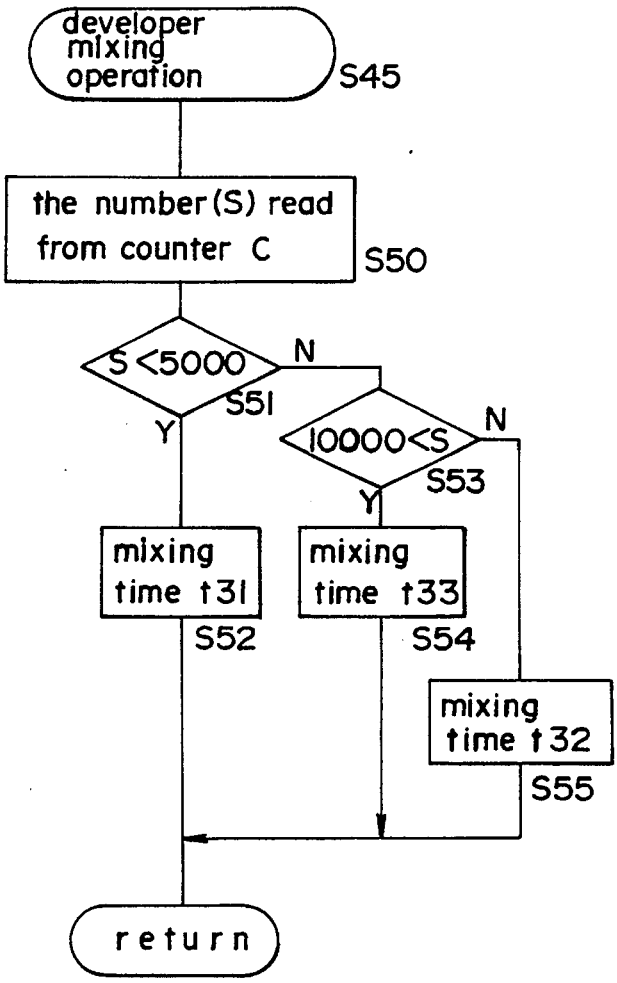
FIG. 12*b* is a flow chart showing the control of the mixing times for the same developer in accordance with different total number of developing cycles.
Figure 13:
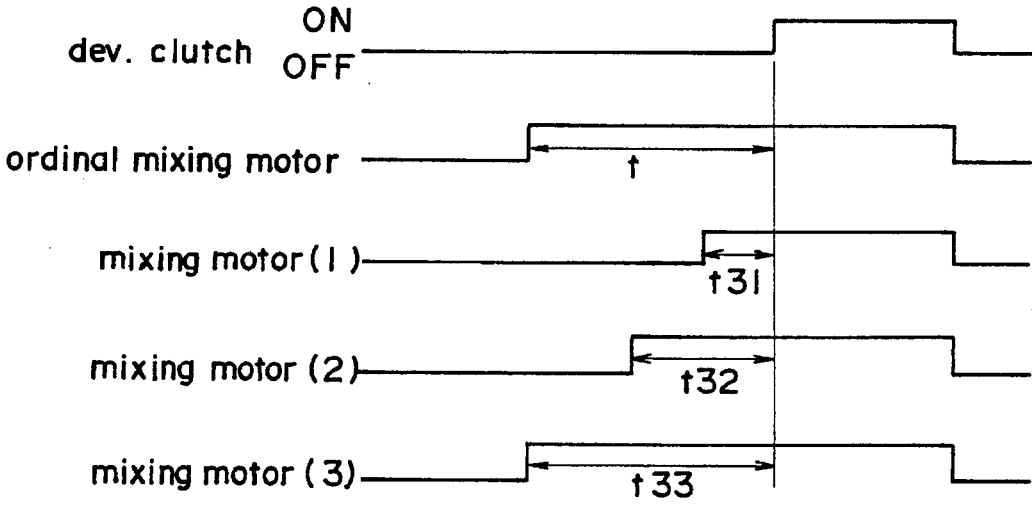
FIG. 13 is an operation timing chart for the mixing sections and developing sections of a conventional developing device and the developing device of the present invention.

The counter adds [1] each time a single developing operation ends in step S47 of FIG. 12*a*. As shown in FIG. 12*b*, the total number of copy sheets S is read from the counter C and input to the CPU when mixing is executed (step S50). In the CPU, a check is made to determine whether or not S<5,000 (sheets) (step S51). If the reply to the query is YES, the mixing time is set at t31 (step S52). If the reply to the query is NO, a check is made to determine whether or not 10,000<S (step S53). If the reply to the query is YES, the mixing time is set at t33 (step S54). If the reply to the query is NO, the total number of copy sheets is determined to be 5,000≦S≦10,000, and the mixing time is set at t32 (step S55). After the mixing motor has operated for the set time only, the developing clutch is turned ON to operate the developing section 10, as shown in FIG. 13. When a single developing operation ends, the counter adds [1].

(B-4) Control based on toner density, developer idle time, and frequency of use

Figure 14:
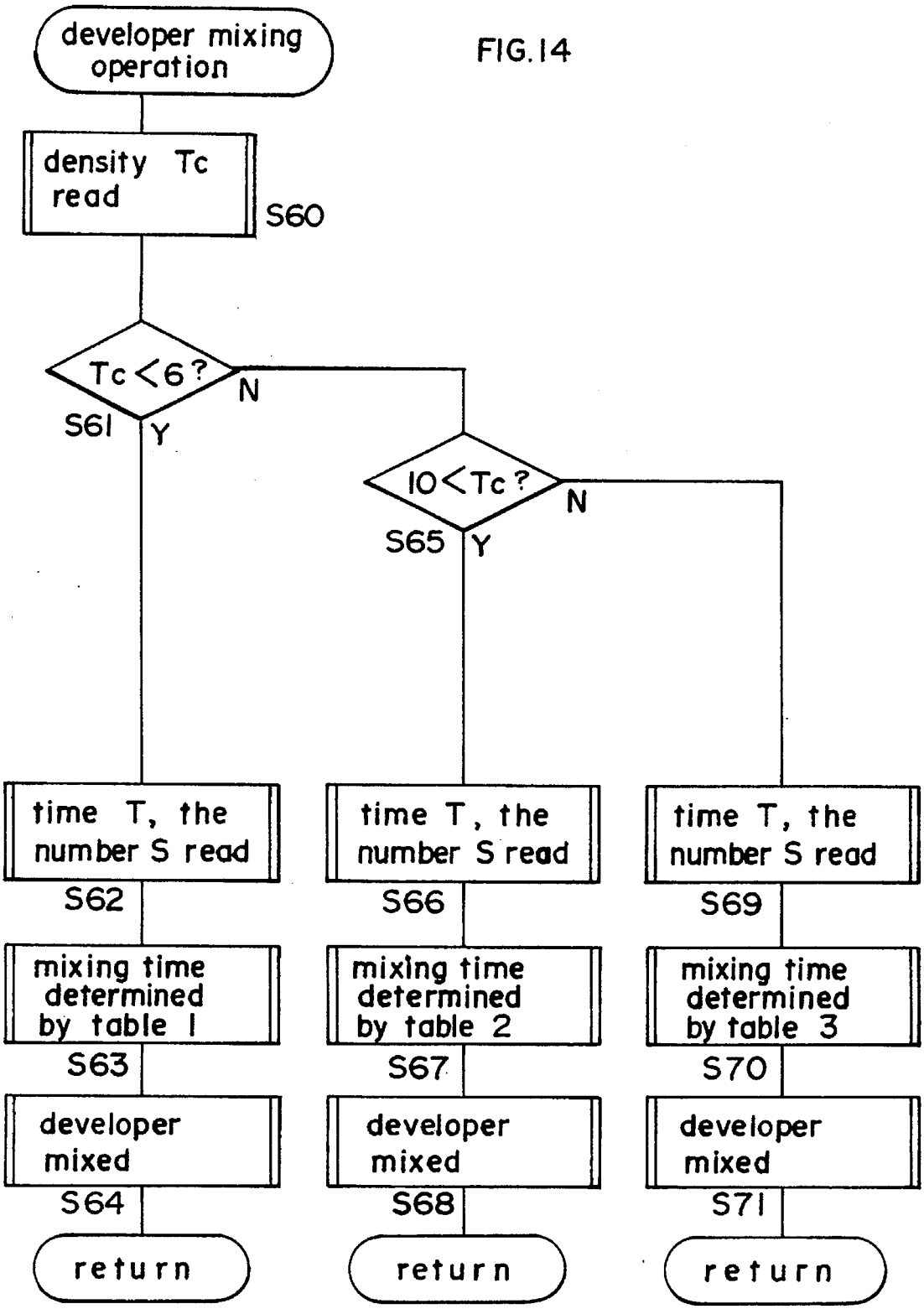
FIG. 14 is a flow chart describing the control of the mixing times for developer having different toner densities, developers which have been allowed to stand idle for different lengths of time, and the same developer in accordance with different total number of developing cycles.

The control of the mixing time when the aforesaid memory M, timer TM and counter C are all provided is described hereinafter with reference to FIG. 14. The various functions of the memory M, timer TM and counter C are identical to those previously described and are, therefore, omitted from the present discussion.

When mixing is executed, the toner density Tc is read out from the memory M and input to the CPU (step S60). In the CPU, a check is made to determine whether or not Tc<6 (step S61). If the reply to the query is YES, then the developer idle time and total number of sheets for the same developer are read out from the timer TM and counter C (step S62). The optimum mixing time is set from Table 1 based on the aforesaid values. For example, when the toner density is less than 6%, the developer idle time is less than 1 hour, and the total number of copy sheets is less than 5,000 sheets, the mixing time is set at t111 (step S63). In the present embodiment, the mixing time is set specifically as indicated in Table 1A, Accordingly, in this case the developing section operation starts[0] (zero) seconds without pre-development mixing (step S64).

If the to the query is NO in the determination that Tc<6, a check is made to determine whether or not 10<Tc (step S65). If the reply to the query is YES, the program continues to step S66, whereas if the reply to the query is NO, the program advances to step S69. When the program continues to step S66, the mixing time is set in accordance with Table 2, and when the program advances to step S69, the mixing time is set in accordance with Table 3. Details are identical to the advance to step S62 and are, therefore, omitted in from the present discussion, whereas Tables 2A and 3A express specific mixing times.

TABLE 1

Relationship between developer idle time, number of copy sheets, and mixing time

| When Tc < 6 | | Number of copies (S) | | |
|---|---|---|---|---|
| | | S < 5,000 | 5,000 ≦ S ≦ 10,000 | 10,000 < S |
| Developer Idle Time | T < 1 | t111 | t112 | t113 |
| | 1 ≦ T ≦ 50 | t121 | t122 | t123 |

TABLE 1-continued

| Relationship between developer idle time, number of copy sheets, and mixing time | | | | |
|---|---|---|---|---|
| | Number of copies (S) | | | |
| When Tc < 6 | | S < 5,000 | 5,000 ≦ S ≦ 10,000 | 10,000 < S |
| T | 50 < T | t131 | t132 | t133 |

TABLE 2

| Relationship between developer idle time, number of copy sheets, and mixing time | | | | |
|---|---|---|---|---|
| | Number of copies (S) | | | |
| When 6 ≦ Tc ≦ 10 | | S < 5,000 | 5,000 ≦ S ≦ 10,000 | 10,000 < S |
| Developer Idle Time T | T < 1 | t211 | t212 | t213 |
| | 1 ≦ T ≦ 50 | t221 | t222 | t223 |
| | 50 < T | t231 | t232 | t233 |

TABLE 3

| Relationship between developer idle time, number of copy sheets, and mixing time | | | | |
|---|---|---|---|---|
| | Number of copies (S) | | | |
| When 10 < Tc | | S < 5,000 | 5,000 ≦ S ≦ 10,000 | 10,000 < S |
| Developer Idle Time (T) | T < 1 | t311 | t312 | t313 |
| | 1 ≦ T ≦ 50 | t321 | t322 | t323 |
| | 50 < T | t331 | t323 | t333 |

TABLE 1A

| Relationship between developer idle time, number of copy sheets, and mixing time | | | | |
|---|---|---|---|---|
| | Number of copies (S) | | | |
| When Tc < 6 | | S < 5,000 | 5,000 ≦ S ≦ 10,000 | 10,000 < S |
| Developer Idle Time (T) | T < 1 | 0 | 1.0 | 2.0 |
| | 1 ≦ T ≦ 50 | 0.5 | 1.5 | 2.5 |
| | 50 < T | 1.0 | 2.0 | 3.0 |

TABLE 2A

| Relationship between developer idle time, number of copy sheets, and mixing time | | | | |
|---|---|---|---|---|
| | Number of copies (S) | | | |
| When 6 ≦ Tc ≦ 10 | | S < 5,000 | 5,000 ≦ S ≦ 10,000 | 10,000 < S |
| Developer Idle Time (T) | T < 1 | 2.0 | 3.0 | 4.0 |
| | 1 ≦ T ≦ 50 | 2.5 | 3.5 | 4.5 |
| | 50 < T | 3.0 | 4.0 | 5.0 |

TABLE 3A

Figure 15:
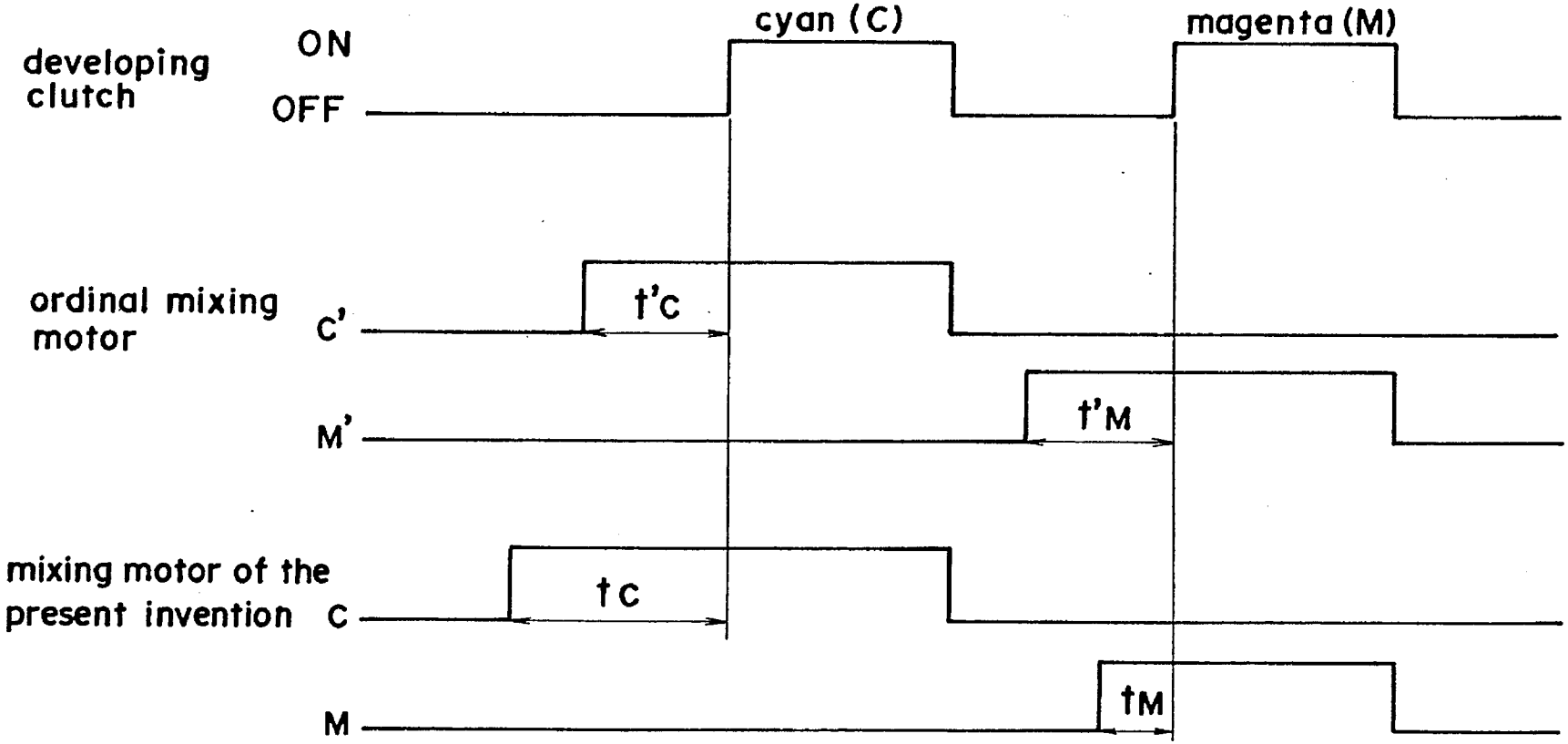
FIG. 15 is a timing chart which compares the operation timing of each developing device within a conventional developing unit and each developing device within the developing unit of the present invention.

| Relationship between developer idle time, number of copy sheets, and mixing time | | | | |
|---|---|---|---|---|
| | Number of copies (S) | | | |
| When 10 < Tc | | S < 5,000 | 5,000 ≦ S ≦ 10,000 | 10,000 < S |
| Developer Idle Time (T) | T < 1 | 4.0 | 5.0 | 6.0 |
| | 1 ≦ T ≦ 50 | 4.5 | 5.5 | 6.5 |
| | 50 < T | 5.0 | 6.0 | 7.0 |

the aforesaid are examples of controls for the developer mixing time prior to development related to the present invention. Accordingly, the optimum mixing times are set for each separate developing device, as shown in FIG. 15, whereas the mixing times for a plurality of developing devices in a developing unit are all set identically in a conventional developing device.

Detecting means may be provided to detect developer condition and surrounding environmental conditions (e.g., humidity), and the operating time of the mixing means may be controlled in accordance with said values as factors causing variation in the necessary minimum mixing time other than those previously described.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a developing device accommodating a developer for developing an electrostatic latent image formed on a surface of a latent image carrier;

a developing member provided in said developing device for supplying the developer to the electrostatic latent image formed on the surface of the latent image carrier;

a mixing member provided in the developing device for mixing the developer accommodated within the developing device;

detecting means for detecting a condition of the developer, said detecting means including at least one of memory means for storing a toner density detected by a sensor which is provided in the developing device at an end of developing, clock means for clocking a developer standing idle time, and calculating means for calculating a total number of developing cycles with the same developer; and control means for controlling an operating time of the mixing member prior to the start of operation of the developing member based on the value obtained by said detecting means.

2. An image forming apparatus comprising:

a developing device accommodating a developer for developing an electrostatic latent image formed on a surface of a latent image carrier;

a developing member provided in said developing device for supplying the developer to the electrostatic latent image formed on the surface of the latent image carrier;

a mixing member provided in the developing device for mixing the developer accommodated within the developing device;

detecting means for detecting a condition of the developer, said detecting means including at least one of memory means for storing a toner density at an end of developing, clock means for clocking a developer standing idle time, and calculating means for calculating a total number of developing cycles with the same developer and a total number of copy sheets copied with the same developer; and control means for controlling an operating time of the mixing member prior to the start of operation of the developing member based on the value obtained by said detecting means.

3. An image forming apparatus comprising:

a developing device accommodating a developer for developing an electrostatic latent image formed on a surface of a latent image carrier;

a developing member provided in said developing device for supplying the developer to the electrostatic latent image formed on the surface of the latent image carrier;

a mixing member provided in the developing device for mixing the developer accommodated within the developing device;

memory means for storing a toner density at an end of developing;

clock means for clocking a developer standing idle time;

calculating means for calculating a total number of developing cycles with the same developer; and control means for controlling an operating time of the mixing member prior to the start of operation of the developing member based on the value obtained by said detecting means, said clock means and said calculating means.

4. An image forming apparatus as claimed in claim 3, wherein said memory means stores the toner density detected by a sensor which is provided in the developing device.

5. An image forming apparatus as claimed in claim 3, wherein said clocking means clocks the time the developer stands idle from an end of one completed developing operation to a start of mixing for the subsequent developing operation.

6. An image forming apparatus as claimed in claim 3, wherein said calculating means calculates a total number of copy sheets copied with the same developer.

7. An image forming apparatus comprising:

a developing device which develops an electrostatic latent image formed on a latent image carrier;

a mixing member which is provided in the developing device to mix a developer accommodated in the developing device;

a memory which stores a toner density of the developer when said developing device terminates a developing operation; and a controller which controls an operating time period of the mixing member prior to a start of a subsequent developing operation in accordance with the toner density stored in said memory.

8. An image forming apparatus as claimed in claim 7, wherein said controller makes the operating time period longer as the toner density becomes higher.

9. An image forming apparatus as claimed in claim 8, further comprising a sensor which is provided in said developing device which sensor outputs a signal corresponding to the toner density of the developer accommodated in the developing device.

10. An image forming apparatus comprising:

a developing device which develops an electrostatic latent image formed on a latent image carrier;

a mixing member which is provided in the developing device to mix a developer accommodated in the developing device;

a counter which counts a total number of developing cycles with the same developer; and a controller which controls an operating time period of the mixing member prior to a start of a subsequent developing operation in accordance with the total number counted by said counter.

11. An image forming apparatus as claimed in claim 10, wherein said controller makes the operating time period longer as the total number of developing cycles becomes larger.

12. An image forming apparatus as claimed in claim 10, further comprising a memory which stores a toner density of the developer when said developing device terminates a developing operation, wherein said controller makes the operating time period in accordance with the total number counted by said counter and the toner density stored in said memory.

13. An image forming apparatus as claimed in claim 10, further comprising a clock which clocks a developer standing idle time, wherein said controller makes the operating time period in accordance with the total number counted by said counter and the developer standing idle time by said clock.

14. An image forming apparatus comprising:

a developing device which develops an electrostatic latent image formed on a latent image carrier;

a mixing member which is provided in the developing device to mix a developer accommodated in the developing device;

a clock which clocks a developer standing idle time;

a controller which controls an operating time period of the mixing member prior to a start of a subsequent developing operation in accordance with the developer standing idle time clocked by said clock; and a memory which stores a toner density of the developer when said developing device terminates a developing operation, wherein said controller makes the operating time period in accordance with the toner density stored in said memory and the developer standing idle time clocked by said clock.

* * * * *